US007150609B2

(12) United States Patent
Kiem et al.

(10) Patent No.: US 7,150,609 B2
(45) Date of Patent: Dec. 19, 2006

(54) ECCENTRIC COUPLING DEVICE IN RADIAL COMPLIANCE SCROLL COMPRESSOR

(75) Inventors: Myung-Kyun Kiem, Incheon (KR); Byung-Kil Yoo, Seoul (KR); Dong-Won Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 128 days.

(21) Appl. No.: 10/872,373

(22) Filed: Jun. 22, 2004

(65) Prior Publication Data

US 2005/0129552 A1 Jun. 16, 2005

(30) Foreign Application Priority Data

Dec. 16, 2003 (KR) ..... 10-2003-0091939

(51) Int. Cl.
*F04C 18/02* (2006.01)
*F04C 18/00* (2006.01)
*F03C 2/00* (2006.01)

(52) U.S. Cl. ..... 418/55.5; 418/55.1; 418/57; 418/182

(58) Field of Classification Search ..... 418/55.5, 418/57, 182

See application file for complete search history.

(56) References Cited

U.S. PATENT DOCUMENTS 4,580,956 A 4/1986 Takahashi et al.
4,838,773 A 6/1989 Noboru
5,104,302 A * 4/1992 Richardson, Jr. ..... 418/55.5
5,199,862 A 4/1993 Kondo et al.
5,378,129 A * 1/1995 Dunaevsky et al. ..... 418/55.5
5,452,995 A * 9/1995 Izumi et al. ..... 418/55.5
5,458,472 A * 10/1995 Kobayashi et al. ..... 418/55.5
5,496,158 A * 3/1996 Barito et al. ..... 418/55.5
5,531,578 A 7/1996 Takemoto et al.
5,536,152 A 7/1996 Kawahara et al.
5,779,461 A * 7/1998 Iizuka et al. ..... 418/55.5
6,461,131 B1 * 10/2002 Chang ..... 418/55.5
6,676,391 B1 * 1/2004 Koo et al. ..... 418/55.5
2002/0001532 A1 1/2002 Chang

FOREIGN PATENT DOCUMENTS

JP 4-175486 6/1992

(Continued)

OTHER PUBLICATIONS

English Language Abstract of JP 6-147145.

(Continued)

*Primary Examiner*—Theresa Trieu
(74) *Attorney, Agent, or Firm*—Greenblum & Bernstein, P.L.C.

(57) ABSTRACT

An eccentric coupling device in a radial compliance scroll compressor including a crank pin eccentrically arranged at an upper end of a crankshaft included in the scroll compressor, and provided with a vertically-extending cut surface at one side thereof, a bush fitted around the crank pin, and provided with a crank pin hole and a stopper hole, a stopper fitted in the stopper hole, and an engagement jaw adapted to prevent a vertical movement of the stopper, thereby preventing a vertical movement of the bush, the engagement jaw being provided at an upper end of the crank pin. The bush is arranged such that an upper end thereof is flush with an upper end of the crank pin. The stopper hole overlaps with the crank pin hole so that the stopper selectively comes into contact with the cut surface in accordance with a rotation of the crank pin. The stopper has a length shorter than that of the stopper hole.

11 Claims, 9 Drawing Sheets

FOREIGN PATENT DOCUMENTS

| | | | | |
|---|---|---|---|---|
| JP | 6-147145 | | | 5/1994 |
| JP | 10-220369 | | | 8/1998 |
| JP | 10220369 | A | * | 8/1998 |
| JP | 2000-073970 | | | 3/2000 |
| JP | 2000073970 | A | * | 3/2000 |
| JP | 2003-343454 | | | 12/2003 |
| KR | 10-0183502 | | | 12/1995 |
| KR | 10-0371171 | | | 1/2002 |

OTHER PUBLICATIONS

English Language Abstract of JP 10-220369.
English Language Abstract of JP 2000-073970.
English Language Abstract of KR 10-0183502.
English Language Abstract of JP 2003-343454.
English Language Abstract of JP 4-175486.
English Language Abstract of KR 10-2002-0002874.

* cited by examiner

ECCENTRIC COUPLING DEVICE IN RADIAL COMPLIANCE SCROLL COMPRESSOR

BACKGROUND OF THE INVENTION

1. Field of the Invention

The present invention relates to a scroll compressor, and more particularly to an eccentric coupling device in a radial compliance scroll compressor, which is capable of preventing abnormal behavior of an eccentric bush caused by a pressure difference between upper and lower ends of the eccentric bush during operation of the scroll compressor, while preventing the eccentric bush from rising axially.

2. Description of the Related Art

Generally, a scroll compressor includes upper and lower scrolls respectively provided with involute-shaped wraps engaged with each other. One of the scrolls performs an orbiting motion with respect to the other scroll to reduce the volume of spaces defined between the scrolls, thereby compressing gas confined in the spaces.

As such a conventional compressor, a radial compliance scroll compressor is known. In such a radial compliance scroll compressor, an orbiting scroll thereof is backwardly moved when liquid refrigerant, oil or foreign matter is introduced into compression chambers defined between the orbiting scroll and the other scroll, that is, a fixed scroll, thereby abnormally increasing the gas pressure in the compression chambers. In accordance with the backward movement of the orbiting scroll, it is possible to prevent the wraps of the scrolls from being damaged due to the abnormally increased gas pressure.

FIG. 1 is a sectional view illustrating the entire configuration of a conventional radial compliance scroll compressor.

As shown in FIG. 1, the conventional radial compliance scroll compressor includes a shell 1, and main and sub frames 2 and 3 respectively arranged in the shell 1 at upper and lower portions of the shell 1. A stator 4, which has a hollow structure, is interposed between the main and sub frames 2 and 3 within the shell 1.

A rotor 5 is arranged inside the stator 4 such that it rotates when current flows through the stator 4. A vertical crankshaft 6 extends axially through a central portion of the rotor 5 while being fixed to the rotor 5 so that it is rotated along with the rotor 5. The crankshaft 6 has upper and lower ends protruded beyond the rotor 5, and rotatably fitted in the main and sub frames 2 and 3, respectively. Thus, the crankshaft 6 is rotatably supported by the main and sub frames 2 and 3.

An orbiting scroll 7 is mounted to an upper surface of the main frame 2 in the shell 1. The orbiting scroll 7 is coupled, at a lower portion thereof, with the upper end of the crankshaft 6, which is protruded through the main frame 2, so that it performs an orbiting motion in accordance with rotation of the crankshaft 6. The orbiting scroll 7 is provided, at an upper portion thereof, with an orbiting wrap 7*a* having an involute shape. The orbiting wrap 7*a* extends upwardly from an upper surface of the orbiting scroll 7. A fixed scroll 8 is arranged on the orbiting scroll 7 in the shell 1 while being fixed to the shell 1. The fixed scroll 8 is provided, at a lower portion thereof, with a fixed wrap 8*a* adapted to be engaged with the orbiting wrap 7*a* of the orbiting scroll 7 such that compression chambers 22 are defined between the wraps 7*a* and 8*a*. With this configuration, when the orbiting scroll 7 performs an orbiting motion in accordance with rotation of the crankshaft 6, gaseous refrigerant is introduced into the compression chambers 22 in a sequential fashion, so that it is compressed.

For the orbiting motion thereof, the orbiting scroll 7 is eccentrically coupled to the crankshaft 6. For this eccentric coupling, the crankshaft 6 is provided with a crank pin 10 upwardly protruded from the upper end of the crankshaft 6 at a position radially spaced apart from the center of the upper end of the crankshaft 6 by a certain distance. Also, the orbiting scroll 7 is provided, at the lower portion thereof, with a boss 7*b* centrally protruded from a lower surface of the orbiting scroll 7.

A bearing 11 is forcibly fitted in the boss 7*b*. Also, an eccentric bush 12 is rotatably fitted around the crank pin 10. The crank pin 10 of the crankshaft 6 is rotatably received in the boss 7*b* of the orbiting scroll 7 via the bearing 11 and eccentric bush 12, so that the orbiting scroll 7 is eccentrically coupled to the crankshaft 6.

As a rotation preventing mechanism for the orbiting scroll 7, an Oldham ring 9 is arranged between the main frame 2 and the orbiting scroll 7. An oil passage 6*a* extends vertically throughout the crankshaft 6. Upper and lower balance weight members are provided at upper and lower surfaces of the rotor 5, respectively, in order to prevent a rotation unbalance of the crankshaft 6 caused by the crank pin 10.

In FIG. 1, reference numerals 15 and 16 designate suction and discharge pipes, respectively, reference numerals 17 and 18 designate a discharge port and a discharge chamber, respectively, reference numeral 19 designates a check valve, reference numeral 20 designates oil, and reference numeral 21 designates an oil propeller.

When current flows through the stator 4, the rotor 5 is rotated inside the stator 4, thereby causing the crankshaft 6 to rotate. In accordance with the rotation of the crankshaft 6, the orbiting scroll 7 coupled to the crank pin 10 of the crankshaft 6 performs an orbiting motion with an orbiting radius defined between the center of the crankshaft 6 and the center of the orbiting scroll 7.

In accordance with a continued orbiting motion of the orbiting scroll 7, the compression chambers 22, which are defined between the orbiting wrap 7*a* and the fixed wrap 8*a*, are gradually reduced in volume, so that gaseous refrigerant sucked into each compression chamber 22 via the suction pipe 15 is compressed to high pressure. The compressed high-pressure gaseous refrigerant is subsequently discharged into the discharge chamber 18 via the discharge port 17. The compressed high-pressure gaseous refrigerant is then outwardly discharged from the discharge chamber 18 via the discharge pipe 16.

Meanwhile, when an abnormal increase in pressure occurs in the compression chambers 22 due to introduction of liquid refrigerant, oil or foreign matter into the compression chambers 22, the orbiting scroll 7 is radially shifted such that the orbiting wrap 7*a* is moved away from the fixed wrap 8*a*, due to the abnormally increased pressure. As a result, it is possible to prevent the wraps 7*a* and 8*a* from being damaged by the abnormally increased pressure.

In the radial compliance scroll compressor having the above mentioned configuration, the eccentric bush 12 is coupled to the crank pin 10 in the above mentioned manner, in order to vary the orbiting radius of the orbiting scroll 7. Also, the eccentric bush 12 generates a centrifugal force corresponding to an eccentricity thereof, that is, the distance between the center of the crank pin 10 and the center of the eccentric bush 12, during the orbiting motion of the orbiting scroll 7. By virtue of this centrifugal force, the eccentric bush 12 can perform a sealing function for the compression chambers 22.

FIG. 2 is an exploded perspective view illustrating a structure of the conventional eccentric bush.

As shown in FIG. 2, the eccentric bush 12 has a crank pin hole 12*b* so that it is rotatably fitted around the crank pin 10. When an abnormal increase in pressure occurs in the compression chambers 22, the eccentric bush 12 is rotated such that the orbiting scroll 7 is radially shifted to cause the orbiting wrap 7*a* to be moved away from the fixed wrap 8*a*.

In order to limit the rotation of the eccentric bush 12 to a predetermined angle, the crank pin 10 has a cutout having a D-shaped cross-section, and thus, a cut surface 10*a*, at one side thereof. The eccentric bush 12 also has a stopper hole 12*a* at one side of the crank pin hole 12*b*. A cylindrical stopper 23 is fitted in the stopper hole 12*a*. The stopper hole 12*a* is arranged such that it overlaps with the crank pin hole 12*b*, so that the cylindrical stopper 23 fitted in the stopper hole 12*a* is radially protruded into the crank pin hole 12*b*.

FIGS. 3*a* and 3*b* are cross-sectional views respectively illustrating different operation states of the eccentric bush shown in FIG. 2.

At a normal position of the eccentric bush 12, the stopper 23 is spaced apart from the cut surface 10*a*, as shown in FIG. 3*a*.

When the eccentric bush 12 is rotated, as indicated by an arrow in FIG. 3*b*, the stopper 23 is rotated, along with the eccentric bush 12, so that it comes into contact with the cut surface 10*a*. Thus, the rotation of the eccentric bush 12 is limited to a certain range.

Meanwhile, oil is fed to the upper end of the eccentric bush 12 through the oil passage 6*a* of the crankshaft 6, and then dispersed from the upper end of the eccentric bush 12 to perform a function of lubricating contact portions of the bearing 11 and eccentric bush 12. However, there may be a difference between the amounts of oil respectively supplied to the upper and lower portions of the eccentric bush 12.

Such an oil supply amount difference may generate friction between the bearing 11 and the eccentric bush 12 at the lower portion of the eccentric bush 12. Such friction may cause the eccentric bush 12 to rise axially.

The eccentric bush 12 has an inner peripheral surface roughly machined as compared to an outer peripheral surface thereof to be in slidable contact with the bearing 11. Due to the roughness of the inner peripheral surface of the eccentric bush 12, increased friction is generated between the eccentric bush 12 and the crank pin 10. For this reason, the eccentric bush 12 exhibits abnormal behavior. For example, the eccentric bush 12 may be repeatedly moved in upward and downward directions without being maintained at a fixed vertical position as it is repeatedly rotated in forward and backward directions during operation of the scroll compressor. Due to such abnormal behavior, the eccentric bush 12 may be axially elevated.

When the eccentric bush 12 is axially elevated due to various causes including a self-moment thereof, the contact area between the eccentric bush 12 and the crank pin 10 is reduced by the elevation length of the eccentric bush 12.

For this reason, a tilting phenomenon may occur. That is, the eccentric bush 12 may be upwardly moved in a state of being inclined to one side thereof. Such a tilting phenomenon causes an increase in the frictional force generated between the eccentric bush 12 and the bearing 11. As a result, the mechanism of the scroll compressor may be damaged. Furthermore, the performance of the scroll compressor may be degraded.

SUMMARY OF THE INVENTION

The present invention has been made in view of the above mentioned problems, and an object of the invention is to provide an eccentric coupling device in a radial compliance scroll compressor, which is capable of preventing a pressure difference from being generated between upper and lower ends of an eccentric bush due to a difference between the amounts of oil, respectively supplied to the upper and lower portions of the eccentric bush 12, caused by dispersion of oil at the upper end of the eccentric bush, while preventing the eccentric bush from rising axially when it repeats forward and backward movements thereof during the compression operation of the scroll compressor.

Another object of the invention is to provide an eccentric coupling device in a scroll compressor which has a simple construction while being capable of achieving the above object.

Another object of the invention is to provide an eccentric coupling device in a scroll compressor which is capable of preventing an eccentric bush carrying a stopper from rising axially at either a normal position or a rotated position.

In accordance with an aspect, the present invention provides an eccentric coupling device in a radial compliance scroll compressor comprising: a crank pin eccentrically arranged at an upper end of a crankshaft included in the scroll compressor, and provided with a vertically-extending cut surface at one side thereof; a bush provided with a crank pin hole adapted to receive the crank pin, and a stopper hole provided at the eccentric bush at one side of the crank pin hole such that the stopper hole overlaps with the crank pin hole; a stopper fitted in the stopper hole such that the stopper is radially protruded into the crank pin hole toward the cut surface to selectively come into contact with the cut surface in accordance with a rotation of the bush; and a vertical movement preventing device adapted to prevent a vertical movement of the stopper, thereby preventing a vertical movement of the eccentric bush, the vertical movement preventing device being provided at an upper end of the crank pin.

The vertical movement preventing device prevents abnormal behavior of the eccentric bush caused by a pressure difference between upper and lower ends of the eccentric bush, and an axial elevation of the eccentric bush occurring during rotation of the eccentric bush.

The vertical movement preventing device may comprise an engagement jaw horizontally protruded from an upper end of the cut surface such that the engagement jaw is engagable with a part of the stopper fitted in the stopper hole. The engagement jaw may be integral with the crank pin. In this case, it is possible to simply form the engagement jaw, and to prevent a vertical movement of the stopper with the simple structure.

The engagement jaw may be detachably attached to the cut surface. Since the engagement jaw is detachable from the crank pin, it is possible to simply achieve replacement of the engagement jaw, while reliably preventing a vertical movement of the stopper with the simple structure.

The engagement jaw may be provided with a stopper insertion allowing groove formed to extend vertically, and adapted to allow the stopper to be vertically inserted into the stopper hole. By virtue of the stopper insertion allowing groove, the stopper can be simply fitted in the stopper hole without being obstructed by the engagement jaw.

The stopper insertion allowing groove may be arranged such that it is aligned with the stopper hole when a center of the bush is positioned at a position thereof spaced away from a center of the crankshaft in accordance with a rotation of the bush. In accordance with this arrangement of the stopper insertion allowing groove, the stopper is allowed to be inserted into the stopper hole in the process of assembling the scroll compressor, while being prevented from being separated from the stopper hole via the stopper insertion allowing groove during the normal operation of the scroll compressor.

The stopper insertion allowing groove may have an arc shape having a radius of curvature larger than a diameter of the stopper. In accordance with this shape of the stopper insertion allowing groove, it is possible to more easily fit the stopper in the stopper hole.

The vertical movement preventing device may comprise an engagement disc attached to the upper end of the crank pin to be arranged over the crank pin. The engagement disc may have an outer diameter equal to or smaller than a diameter of the crank pin such that the engagement jaw is engagable with a part of the stopper fitted in the stopper hole, while being provided with a communication hole communicating with an oil passage extending throughout the crankshaft. Since the vertical movement preventing device is implemented by the engagement disc, it is possible to prevent a vertical movement of the stopper with a simple structure. The engagement disc may be provided with a stopper insertion allowing groove formed to extend vertically, and adapted to allow the stopper to be vertically inserted into the stopper hole. By virtue of the stopper insertion allowing groove, it is possible to simply fit the stopper in the stopper hole via the engagement disc.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Now, embodiments of an eccentric coupling device in a radial compliance scroll compressor according to the present invention will be described with reference to the annexed drawings.

Figure 1:
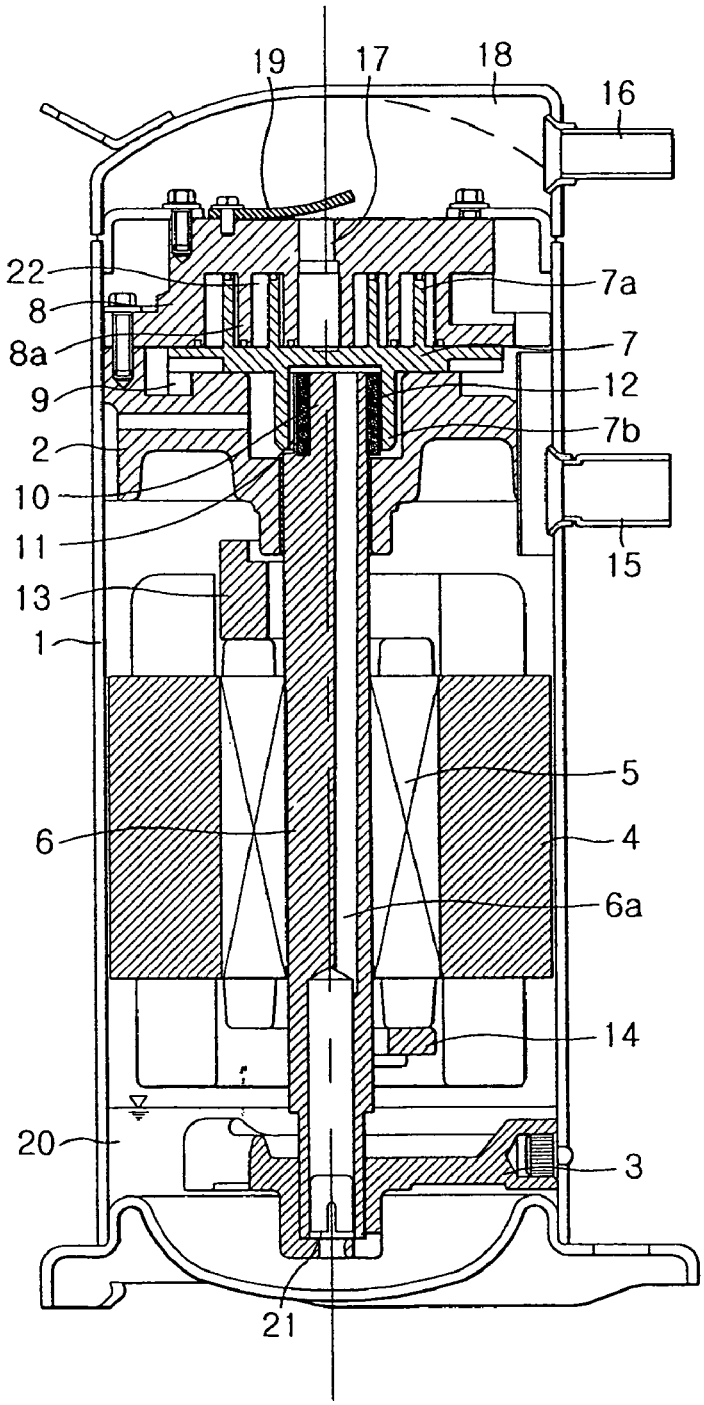
Fig.1 PRIOR ART
FIG. 1 is a sectional view illustrating the entire configuration of a conventional radial compliance scroll compressor.
Figure 2:
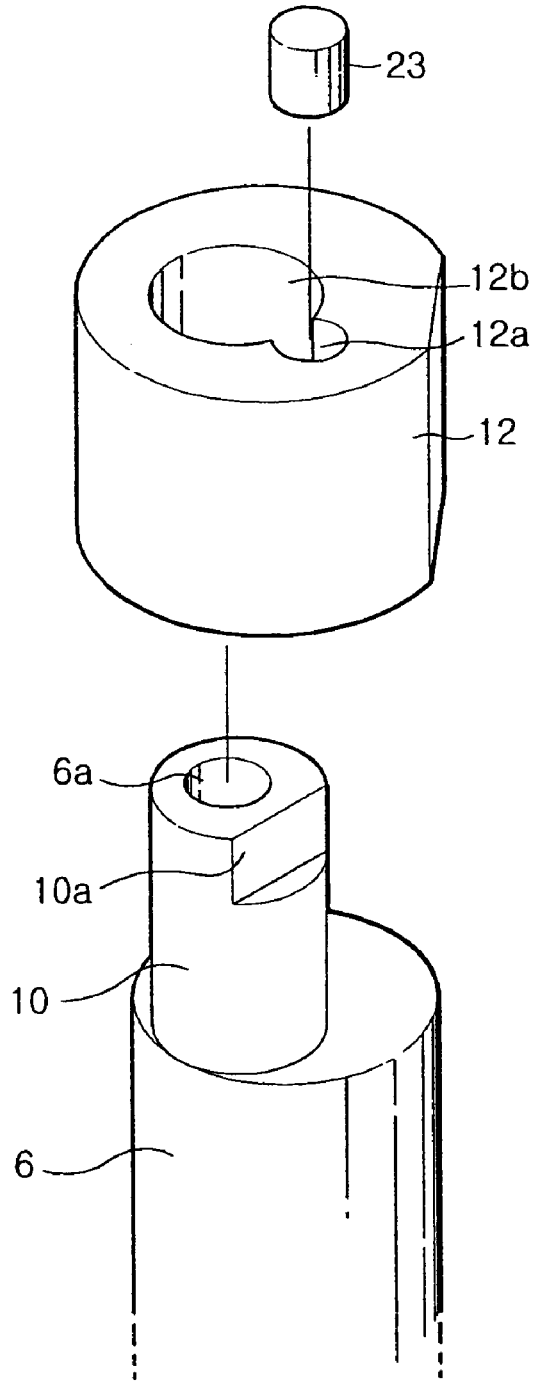
Fig.2 PRIOR ART
FIG. 2 is an exploded perspective view illustrating a structure of a conventional eccentric coupling device.
Figure 3A:
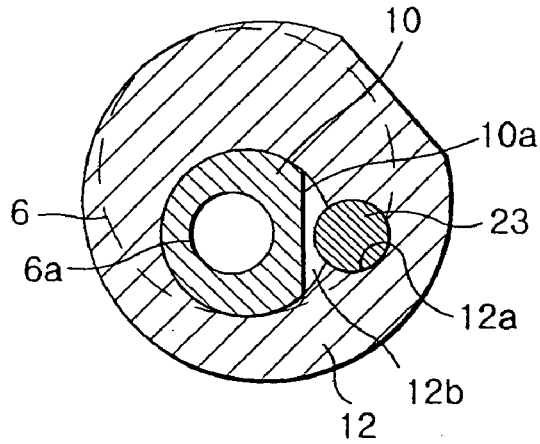
Fig.3a PRIOR ART
FIG. 3*a* is a cross-sectional view illustrating the state in which an eccentric bush of FIG. 2 is positioned at a normal position.
Figure 3B:
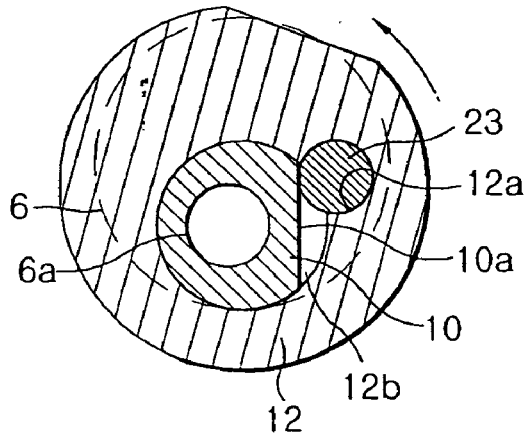
Fig.3b PRIOR ART
FIG. 3*b* is a cross-sectional view illustrating the state in which the eccentric bush of FIG. 2 is positioned at a rotated position.
Figure 4:
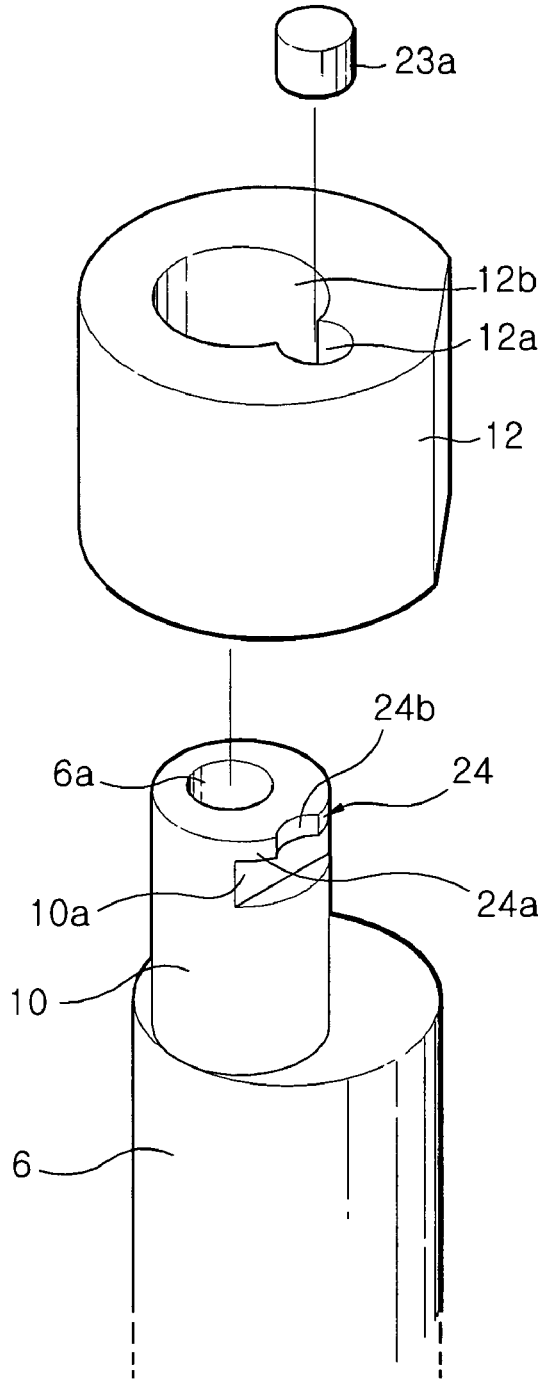
FIG. 4 is an exploded perspective view illustrating an eccentric coupling device according to an embodiment of the present invention.

FIG. 4 is an exploded perspective view illustrating an eccentric coupling device according to an embodiment of the present invention. The eccentric coupling device may be applied to the radial compliance scroll compressor shown in FIG. 1. In order to simplify the description thereof, the eccentric coupling device will be described in conjunction with the case in which it is applied to the radial compliance scroll compressor shown in FIG. 1. In FIG. 4, elements respectively corresponding to those in FIGS. 1 and 2 will be designated by the same reference numerals.

As shown in FIG. 4, the eccentric coupling device includes a crank pin 10 provided at an upper end of a crankshaft 6 such that it is eccentrically arranged with respect to the crankshaft 6, an eccentric bush 12 rotatably fitted around the crank pin 10, a stopper 23*a* fitted in the eccentric bush 12, and a vertical movement preventing device 24 adapted to prevent a vertical movement of the eccentric bush 12.

The eccentric bush 12, which is fitted around the crank pin 10, is flush with the crank pin 10. The eccentric bush 12 is provided with a crank pin hole 12*b* extending vertically throughout the eccentric bush 12, and a stopper hole 12*a* extending vertically into the eccentric bush 12. The crank pin hole 12*b* receives the crank pin 10 such that the crank pin 10 is rotatable therein. The crank pin 10 is provided, at one side thereof, with a cutout formed at an upper portion of the crank pin 10 while having a D-shaped cross-section, and thus, a cut surface 10*a*.

The stopper 23*a* is fitted in the stopper hole 12*a*. The stopper hole 12*a* is arranged such that it overlaps with the crank pin hole 12*b*, so that the cylindrical stopper 23*a* fitted in the stopper hole 12*a* is radially protruded into the crank pin hole 12*b*. In accordance with this arrangement, the stopper 23*a* can come into contact with the cut surface 10*a* in accordance with rotation of the crank pin 10. Accordingly, rotation of the eccentric bush 12 is limited to a certain range.

The stopper 23*a* has a length shorter than that of the stopper hole 12*a*. The stopper 23*a* may be tightly fitted in the stopper hole 12*a* so that it is firmly fixed to the eccentric bush 12. Alternatively, the stopper 23*a* may be formed such that it is integral with the eccentric bush 12.

The vertical movement preventing device 24 comprises an engagement jaw 24*a* protruded from the crank pin 10 at an upper end of the cut surface 10*a* such that it comes into contact with an upper end of the stopper 23*a* positioned below an upper end of the stopper hole 12*a*, so that it is engaged with the stopper 23*a*. The engagement jaw 24*a* is formed such that it is integral with the crank pin 10.

In accordance with the engagement of the engagement jaw 24*a* with the stopper 23*a*, the vertical movement preventing device 24 prevents a vertical movement of the stopper 23*a*, and thus, a vertical movement of the eccentric bush 12 fitted in the crank pin 10. Accordingly, it is possible to prevent a tilting phenomenon of the eccentric bush 12, thereby eliminating a degradation in the compression efficiency and performance of the scroll compressor caused by the tilting phenomenon.

The engagement jaw 24*a* has a D-shaped cross-section corresponding to that of the cutout formed at the upper portion of the crank pin 10 to form the cut surface 10*a*. The engagement jaw 24*a* is provided with a stopper insertion allowing groove 24*b* at a peripheral surface thereof. The stopper insertion allowing groove 24*b* is formed by partially cutting out a peripheral portion of the engagement jaw 24*a* in the form of a C-shaped cutout.

The stopper insertion allowing groove 24*b* is arranged such that it is aligned with the stopper hole 12*a* when the stopper hole 12*a* has been shifted, in accordance with rotation of the eccentric bush 12, from a normal position thereof approximate to the center of the crankshaft 6 to a position thereof spaced away from the center of the crankshaft 6. During a normal operation of the scroll compressor, the stopper hole 12*a* is maintained at the normal position thereof. When the stopper insertion allowing groove 24*b* is aligned with the stopper hole 12*a*, it allows the stopper 23*a* to be vertically inserted into the stopper hole 12*a* without being obstructed by the crank pin 10 including the engagement jaw 24*a*. During the normal operation of the scroll compressor, the stopper 23*a* fitted in the stopper hole 12*a* is not separated from the stopper hole 12*a* by the engagement jaw 24*a*.

The stopper insertion allowing groove 24*b* has an arc shape having a radius of curvature larger than the diameter of the stopper 23*a*. Accordingly, the stopper insertion allowing groove 24*b* allows the stopper 23*a* to be more easily inserted into the stopper hole 12*a*.

Thus, the stopper insertion allowing groove 24*b* has the form of a C-shaped cutout, and serves to allow the stopper 23*a* to be easily fitted in the stopper hole 12*a* in the process of assembling the scroll compressor, while preventing the fitted stopper 23*a* from being separated from the stopper hole 12*a*.

Preferably, the stopper 23*a* has a length shorter than the distance between a lower end of the cut surface 10*a* and a lower surface of the engagement jaw 24*a*. Meanwhile, although the stopper 23*a* has a cylindrical shape in the illustrated case, it is not limited thereto. Provided, the shape of the stopper insertion allowing groove 24*b* should be determined in accordance with the shape of the stopper 23*a*. Also, the engagement jaw 23*a* should have a thickness determined, taking into consideration a force causing elevation of the eccentric bush 12 and stopper 23*a*.

The length of the stopper 23*a* is determined in accordance with the distance between the lower end of the cut surface 10*a* and the lower surface of the engagement jaw 24*a*. In this connection, it is preferred that the length of the stopper 23*a* be shorter than the distance between the lower end of the cut surface 10*a* and the lower surface of the engagement jaw 24*a*, as described above.

Although the stopper 23*a* has a length shorter than the distance between the lower end of the cut surface 10*a* and the lower surface of the engagement jaw 24*a*, there is no adverse affect on a required function of the stopper 23*a*.

Figure 5:
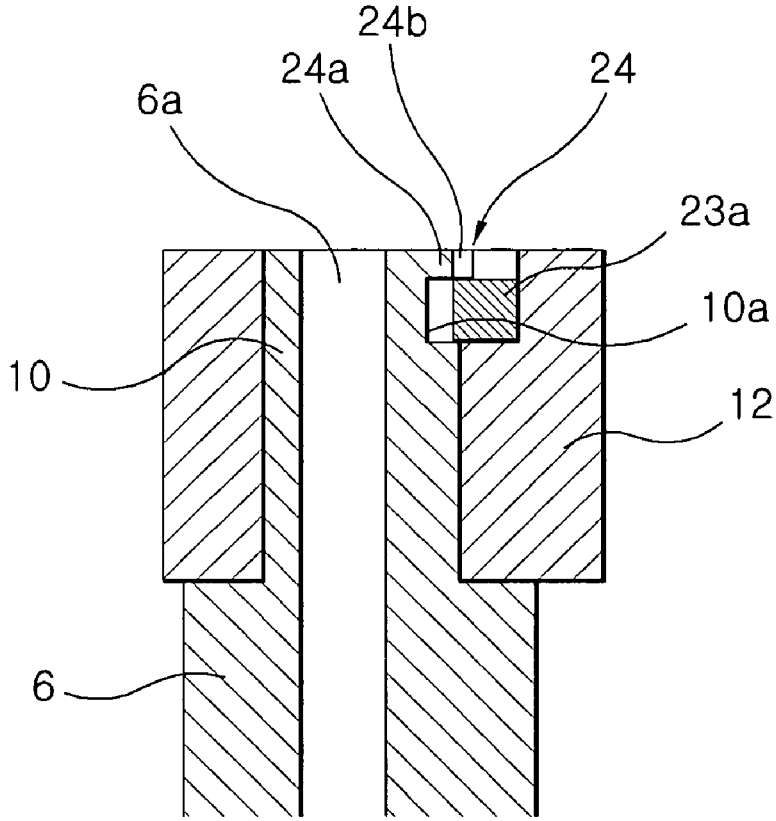
FIG. 5 is a sectional view illustrating an assembled state of the eccentric coupling device shown in FIG. 4.

FIG. 5 is a sectional view illustrating an assembled state of the eccentric coupling device shown in FIG. 4.

As shown in FIG. 5, the engagement jaw 24*a* is horizontally protruded from the upper end of the cut surface 10*a*. The engagement jaw 24*a* is in contact with the upper end of the stopper 23*a* at the lower surface thereof.

As described above, the engagement jaw 24*a* is provided with the stopper insertion allowing groove 24*b*, which extends vertically. The stopper insertion allowing groove 24*b* is selectively aligned with the stopper hole 12*a*, so that it allows the stopper 23*a* to be inserted into the stopper hole 12*a*.

The engagement jaw 24*a* is in contact with the upper end of the stopper 23*a* fitted in the stopper hole 12*a*, so that it is engaged with the stopper 23*a*, thereby preventing a vertical movement of the stopper 23*a*. As the stopper 23*a* is prevented from moving vertically, by the engagement jaw 24*a*, it is possible to simply prevent the eccentric bush 12 from moving vertically with respect to the crank pin 10.

Since the eccentric bush 12 is prevented from moving vertically, by the engagement jaw 24*a*, it is possible to prevent a tilting phenomenon of the eccentric bush 12 caused by abnormal behavior or axial elevation thereof.

Figure 6A:
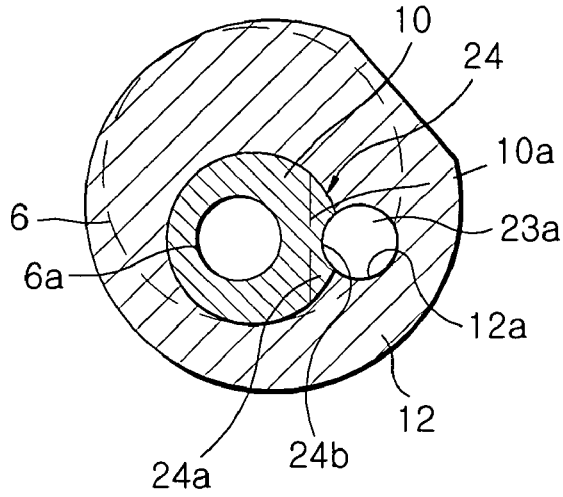
FIG. 6*a* is a cross-sectional view illustrating the state in which AN eccentric bush of FIG. 4 is positioned at a normal position.
Figure 6B:
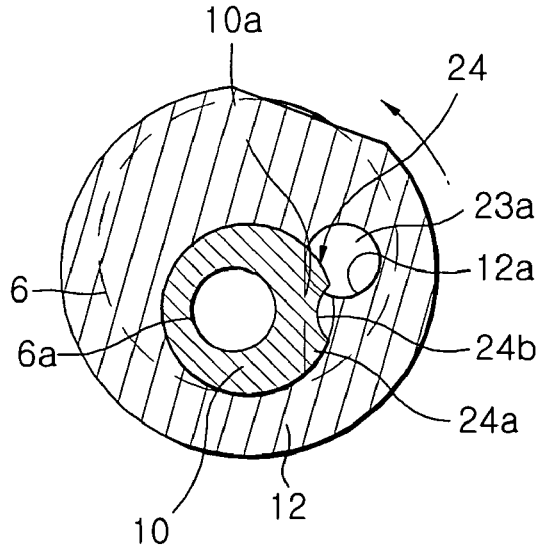
FIG. 6*b* is a cross-sectional view illustrating the state in which the eccentric bush of FIG. 4 is positioned at a rotated position.

FIGS. 6*a* and 6*b* are cross-sectional views respectively illustrating assembled and operating states of the eccentric coupling device shown in FIG. 4. FIG. 6*a* shows an assembled state of the eccentric coupling device, whereas FIG. 6*b* shows an operating state of the eccentric coupling device.

In the process of assembling the radial compliance scroll compressor, the stopper 23*a* is first inserted into the stopper hole 12*a* of the eccentric bush 12 in a state in which the stopper insertion allowing groove 24*b* formed at the engagement jaw 24*a* is aligned with the stopper hole 12*a*, as shown in FIG. 6*a*.

When the scroll compressor is operated in the assembled state shown in FIG. 6*a*, the eccentric bush 12 is rotated, as shown in FIG. 6*b*, because a centrifugal force generated at an initial stage of the operation of the scroll compressor is smaller than a gas pressure in the compression chambers of the scroll compressor.

As a result, the stopper insertion allowing groove 24*b* is misaligned from the stopper hole 12*a*, so that the stopper 23*a* comes into contact with the lower surface of the engagement jaw 24*a* at the upper end thereof. Accordingly, the engagement jaw 24*a* prevents an elevation of the stopper 23*a*, thereby preventing an axial elevation of the eccentric bush 12 coupled with the stopper 23*a*.

Even at a normal position of the eccentric bush 12 where the generated centrifugal force is larger than the gas pressure in the compression chambers in accordance with a continued orbiting motion carried out in the scroll compressor, the stopper 23*a* is maintained in a state of being engaged with the engagement jaw 24*a*. Accordingly, the eccentric bush 12 is still prevented from rising axially.

Thus, the stopper insertion allowing groove 24*a* provided at the engagement jaw 24*a* allows the stopper 23*a* to be easily fitted in the stopper hole 12*a* in the process of assembling the scroll compressor, while preventing the fitted stopper 23*a* from being separated from the stopper hole 12*a* during the operation of the scroll compressor.

Although the vertical movement preventing device 24 has been described as comprising the engagement jaw 24*a*, it is not limited thereto. The vertical movement preventing device 24 may be implemented using other structures, as far as they can allow assembly of the stopper 23*a* while preventing a vertical movement of the stopper 23*a* during forward and backward rotations of the eccentric bush 12.

Figure 7:
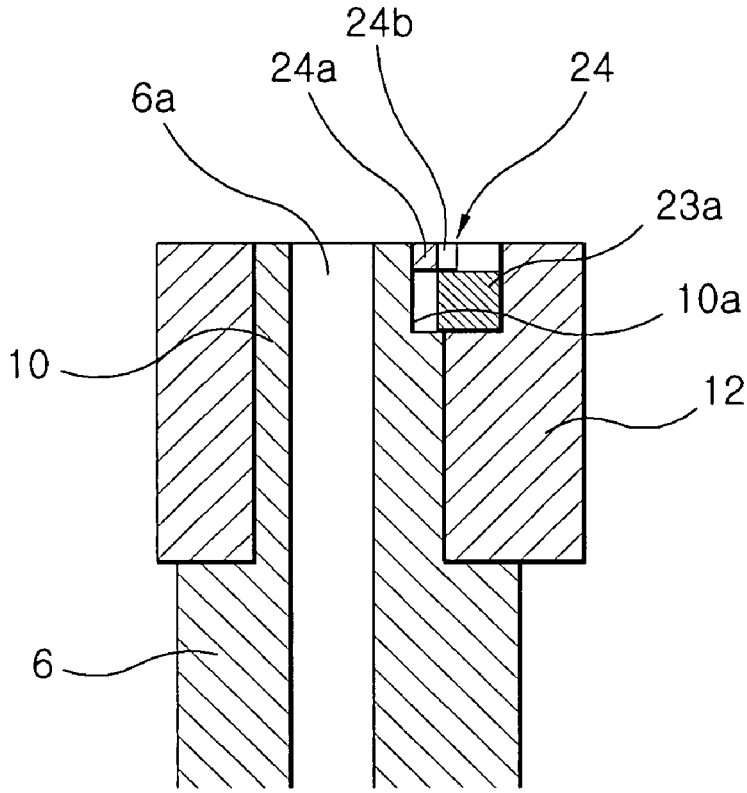
FIG. 7 is a sectional view illustrating an eccentric coupling device according to another embodiment of the present invention.

FIG. 7 is a sectional view illustrating an eccentric coupling device according to another embodiment of the present invention. The eccentric coupling device may be applied to the radial compliance scroll compressor shown in FIG. 1. In order to simplify the description thereof, the eccentric coupling device will be described in conjunction with the case in which it is applied to the radial compliance scroll compressor shown in FIG. 1. In FIG. 7, elements respectively corresponding to those in FIGS. 4 to 6*b* will be designated by the same reference numerals.

Referring to FIG. 7, an eccentric bush 12 is provided with a crank pin hole 12*b* so that it is rotatably fitted around a crank pin 10 of a crankshaft 6 through the crank pin hole 12*b*. The crank pin 10 is provided, at one side thereof, with a cutout formed at an upper portion of the crank pin 10 while having a D-shaped cross-section, and thus, a cut surface 10*a*. A stopper hole 12*a* is also provided at the eccentric bush 12 to extend vertically into the eccentric bush 12. The stopper hole 12*a* is arranged such that it overlaps with the crank pin hole 12*b*, while facing the cut surface 10*a*.

A stopper 23*a* is fitted in the stopper hole 12*a*. The stopper 23*a* has a length shorter than that of the stopper hole 12*a*. As a vertical movement preventing device 24 adapted to prevent a vertical movement of the eccentric bush 12, an engagement jaw 24*a* is attached to an upper end of the cut surface 10*a* to extend horizontally from the cut surface 10*a* such that it comes into contact with an upper end of the stopper 23*a*, so that it is engaged with the stopper 23*a*. In accordance with this engagement, the engagement jaw 24*a* prevents a vertical movement of the stopper 23*a*, and thus, a vertical movement of the eccentric bush 12 fitted in the crank pin 10.

Since the engagement jaw 24*a* is detachably attached to the upper end of the cut surface 10*a*, it is possible to simply achieve replacement of the engagement jaw 24*a*, while reliably preventing a vertical movement of the stopper 23*a*, and thus, the eccentric bush 12, using a simple structure.

The engagement jaw 24*a* is provided with a stopper insertion allowing groove 24*b* at a peripheral surface thereof. The stopper insertion allowing groove 24*b* is arranged such that it is aligned with the stopper hole 12*a* when the stopper hole 12*a* has been shifted, in accordance with rotation of the eccentric bush 12, from a normal position thereof approximate to the center of the crankshaft 6 to a position thereof spaced away from the center of the crankshaft 6. During a normal operation of the scroll compressor, the stopper hole 12*a* is maintained at the normal position thereof. When the stopper insertion allowing groove 24*b* is aligned with the stopper hole 12*a*, it allows the stopper 23*a* to be inserted into the stopper hole 12*a* without being obstructed by the crank pin 10 including the engagement jaw 24*a*. Preferably, the stopper insertion allowing groove 24*b* has an arc shape having a radius of curvature larger than the diameter of the stopper 23*a*.

Figure 8:
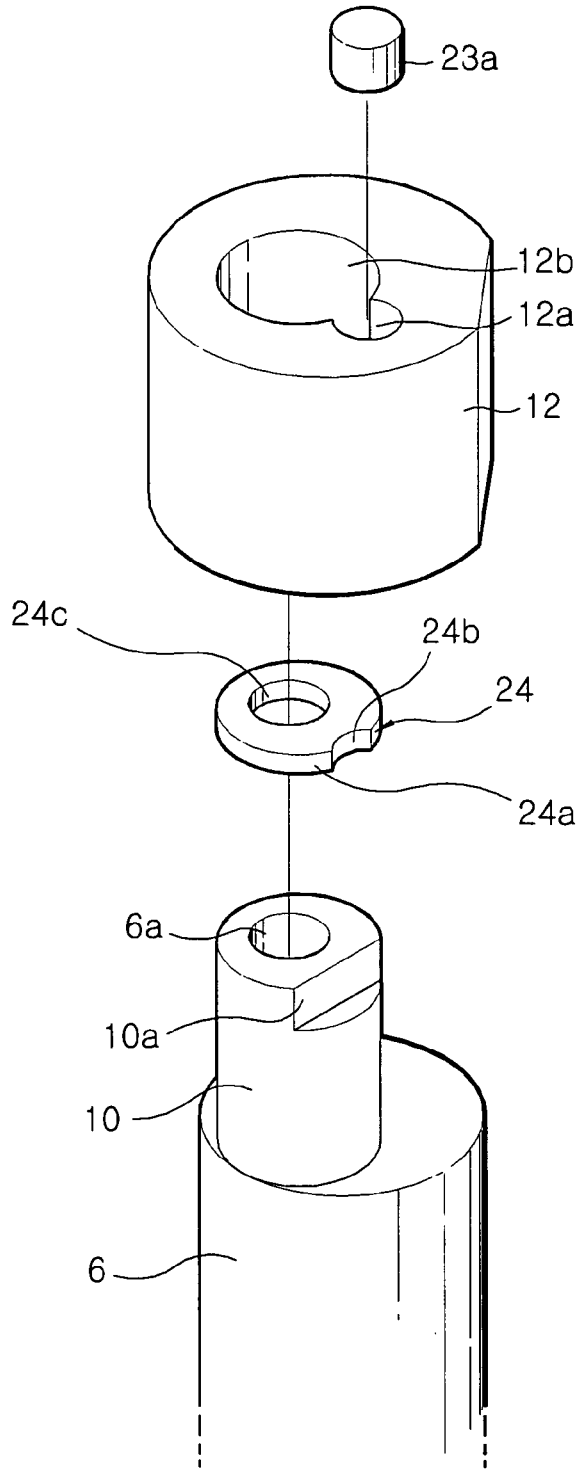
FIG. 8 is an exploded perspective view illustrating an eccentric coupling device according to another embodiment of the present invention.

FIG. 8 is an exploded perspective view illustrating an eccentric coupling device according to another embodiment of the present invention. The eccentric coupling device may be applied to the radial compliance scroll compressor shown in FIG. 1. In order to simplify the description thereof, the eccentric coupling device will be described in conjunction with the case in which it is applied to the radial compliance scroll compressor shown in FIG. 1. In FIG. 8, elements respectively corresponding to those in FIGS. 4 to 6*b* will be designated by the same reference numerals.

As shown in FIG. 8, the eccentric coupling device includes a crank pin 10 provided at an upper end of a crankshaft 6 such that it is eccentrically arranged with respect to the crankshaft 6, an eccentric bush 12 rotatably fitted around the crank pin 10 such that an upper end thereof is arranged at a level higher than that of the crank pin 10, a stopper 23*a* fitted in the eccentric bush 12 such that an upper end thereof is flush with that of the crank pin 10, and a vertical movement preventing device 24 adapted to prevent a vertical movement of the eccentric bush 12.

The eccentric bush 12, which is fitted around the crank pin 10, has a length longer than that of the crank pin 10 so that the upper end thereof is arranged at a level higher than that of the crank pin 10. The eccentric bush 12 is provided with a crank pin hole 12*b* extending vertically throughout the eccentric bush 12, and a stopper hole 12*a* extending vertically into the eccentric bush 12. The crank pin hole 12*b* receives the crank pin 10 such that the crank pin 10 is rotatable therein. The crank pin 10 is provided, at one side thereof, with a cutout formed at an upper portion of the crank pin 10 while having a D-shaped cross-section, and thus, a cut surface 10*a*.

The stopper 23*a* is fitted in the stopper hole 12*a*. The stopper hole 12*a* is arranged such that it overlaps with the crank pin hole 12*b*, so that the cylindrical stopper 23*a* fitted in the stopper hole 12*a* is radially protruded into the crank pin hole 12*b*. In accordance with this arrangement, the stopper 23*a* can come into contact with the cut surface 10*a* in accordance with rotation of the crank pin 10. Accordingly, rotation of the eccentric bush 12 is limited to a certain range.

The stopper 23*a* has a length shorter than that of the stopper hole 12*a* such that the upper end thereof is flush with that of the crank pin 10 in a state of being fitted in the stopper hole 12*a*. The stopper 23*a* may have a reduced length such that the upper end thereof is arranged at a level slightly lower than that of the crank pin 10.

The vertical movement preventing device 24 comprises an engagement disc 24*a* attached to the upper end of the crank pin 10 such that it is arranged over the stopper 23*a* in a state in which the eccentric bush 12 is fitted around the crank pin 10, and the stopper 23*a* is fitted in the eccentric bush 12. The engagement disc 24*a* has an outer diameter equal to or smaller than the diameter of the crank pin 10 while having a thickness determined such that an upper surface thereof is flush with the upper end of the eccentric bush 12. The engagement disc 24*a* is provided with a communication hole 24*c* communicating with an oil passage 6*a* formed through the crank shaft 6.

Since the engagement disc 24*a* is attached to the upper end of the crank pin 10, it prevents a vertical movement of the stopper 23*a*, and thus, a vertical movement of the eccentric bush 12. In order to allow the stopper 23*a* to be vertically inserted into the stopper hole 12*a* in the assembly process, the engagement disc 24*a* is provided with a stopper insertion allowing groove 24*b* at a peripheral portion thereof.

The stopper insertion allowing groove 24*b* is arranged such that it is aligned with the stopper hole 12*a* when the stopper hole 12*a* has been shifted, in accordance with rotation of the eccentric bush 12, from a normal position thereof approximate to the center of the crankshaft 6 to a position thereof spaced away from the center of the crankshaft 6. During a normal operation of the scroll compressor, the stopper hole 12*a* is maintained at the normal position thereof. When the stopper insertion allowing groove 24*b* is aligned with the stopper hole 12*a*, it allows the stopper 23*a* to be inserted into the stopper hole 12*a* without being obstructed by the crank pin 10 including the engagement disc 24*a*. Preferably, the stopper insertion allowing groove 24*b* has an arc shape having a radius of curvature larger than the diameter of the stopper 23*a*.

Since the engagement disc 24*a* attached to the upper end of the crank pin 10 is used as the vertical movement preventing device 24 adapted to prevent a vertical movement of the eccentric bush 12, it is possible to simply implement the vertical movement preventing device 24, and thus, to simply manufacture the scroll compressor according to the present invention.

Figure 9:
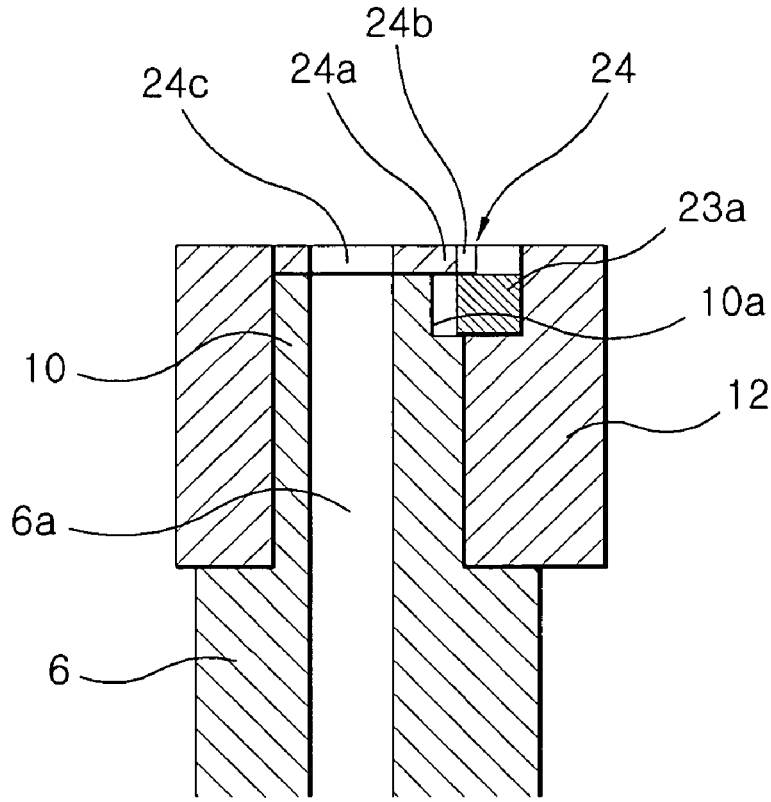
FIG. 9 is a sectional view illustrating an assembled state of the eccentric coupling device shown in FIG. 8.

FIG. 9 is a sectional view illustrating an assembled state of the eccentric coupling device shown in FIG. 8.

In a state in which the crank pin 10 is fitted in the crank pin hole 12*b* of the eccentric bush 12, as shown in FIG. 9, the upper end of the crank pin 10 is arranged at a level lower than that of the eccentric bush 12. To the upper end of the crank pin 10, the engagement disc 24*a* is attached which has a thickness equal to a vertical distance between the upper ends of the crank pin 10 and eccentric bush 12.

The engagement disc 24*a* covers a part of the upper end of the stopper 23*a* protruded into the cutout of the crank pin 10 through the crank pin hole 12*b*. That is, the engagement disc 24*a* is engaged with the upper end of the stopper 23*a*. Accordingly, a vertical movement of the stopper 23*a* is prevented. The attachment of the engagement disc 24*a* to the crank pin 10 may be achieved, using various methods, for example, a welding process.

Thus, the vertical movement preventing device 24 may be simply and conveniently implemented by coupling the crank pin 10 and eccentric bush 12 such that the upper ends thereof have a level difference, and attaching, to the upper end of the crank pin 10, the engagement disc 24*a* having a thickness equal to the level difference.

Also, the engagement disc 24*a* is provided, at a peripheral portion thereof, with the stopper insertion allowing groove 24*b*, while being provided, at a central portion thereof, with the communication hole 24*c* communicating with the oil passage 6*a* extending through the crankshaft 6 and crank pin 10.

As apparent from the above description, in accordance with the present invention, it is possible to prevent a reduction in the contact area between the eccentric bush and the crank pin caused by an axial elevation of the eccentric bush, and thus, a tilting phenomenon of the eccentric bush caused by the contact area reduction. There is also an advantage in that it is possible to eliminate a degradation in the compression efficiency and performance of the scroll compressor caused by increased friction generated between the eccentric bush and the bearing due to the tilting phenomenon.

Such effects can be obtained, using a simple structure. Accordingly, it is possible to achieve an improvement in workability and a reduction in manufacturing costs.

In accordance with the present invention, the reliability of the eccentric bush can be secured because it is possible to prevent an axial elevation of the eccentric bush including the stopper at either the rotated position of the eccentric bush or the normal position of the eccentric bush.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An eccentric coupling device in a radial compliance scroll compressor, the eccentric coupling device comprising:

a crank pin eccentrically arranged at an upper end of a crankshaft included in the scroll compressor, a vertically-extending flat surface provided at one side of the crank pin;

a bush provided with a crank pin hole configured to receive the crank pin, and a stopper hole provided in the bush at one side of the crank pin hole such that the stopper hole overlaps with the crank pin hole;

a stopper fitted in the stopper hate such that the stopper radially protrudes into the crank pin hole toward the flat surface to selectively come into contact with the flat surface in accordance with a rotation of the bush;

a vertical movement preventer configured to prevent a vertical movement of the stopper, thereby preventing a vertical movement of the bush, the vertical movement preventer being provided at an upper end of the crank pin;

wherein the vertical movement preventer comprises a stopper insertion groove through which the stopper is passed at an upper end of the crank pin; and an engagement jaw horizontally protruding from an upper end of the flat surface such that the engagement jaw is engagable with a part of the stopper fitted in the stopper hole.

2. The eccentric coupling device according to claim 1, wherein the engagement jaw is detachably attached to the flat surface.

3. The eccentric coupling device according to claim 1, wherein the stopper insertion groove is aligned with the stopper hole when a center of the bush is positioned at a position spaced from a center of the crankshaft in accordance with a rotation of the bush.

4. The eccentric coupling device according to claim 1, wherein the stopper insertion groove has an arc shape having a radius of curvature larger than a diameter of the stopper.

5. The eccentric coupling device according to claim 1, wherein the vertical movement preventer comprises:

an engagement disc attached to the upper end of the crank pin and positioned over the crank pin, the engagement disc having an outer diameter equal to or smaller than a diameter of the crank pin such that the engagement jaw is engagable with a part of the stopper fitted in the stopper hole, while being provided with a communication hole that communicates with an oil passage extending through the crankshaft.

6. The eccentric coupling device according to claim 5, wherein the stopper insertion groove is aligned with the stopper hole when a center of the bush is positioned at a position spaced from a center of the crankshaft in accordance with a rotation of the bush.

7. The eccentric coupling device according to claim 5, wherein the stopper insertion groove has an arc shape having a radius of curvature larger than a diameter of the stopper.

8. An eccentric coupling device in a radial compliance scroll compressor, the eccentric coupling device comprising:

a crank pin eccentrically arranged at an upper end of a crankshaft included in the scroll compressor, a vertically-extending flat surface provided at one side of the crank pin;

a bush provided with a crank pin hole configured to receive the crank pin, and a stopper hole provided in the bush at one side of the crank pin hole such that the stopper hole overlaps with the crank pin hole;

a stopper fitted in the stopper hole such that the stopper radially protrudes into the crank pin hole toward the flat surface to selectively come into contact with the flat surface in accordance with a rotation of the bush;

a vertical movement preventer configured to prevent a vertical movement of the stopper, thereby preventing a vertical movement of the bush, the vertical movement preventer being provided at an upper end of the crank pin;

wherein the vertical movement preventer comprises a stopper insertion groove through which the stopper is passed at an upper end of the crank pin; the stopper insertion groove having an arc shape having a radius of curvature larger than a diameter of the stopper; and an engagement jaw being engagable with a part of the stopper fitted in the stopper hole.

9. The eccentric coupling device according to claim 8, wherein the engagement jaw is detachably attached to the flat surface.

10. The eccentric coupling according to claim 8, wherein the vertical movement preventer comprises:

an engagement disc attached to the upper end of the crank pin and positioned over the crank pin, the engagement disc having an outer diameter equal to or smaller than a diameter of the crank pin such that the engagement jaw is engagable with a part of the stopper filled in the stopper hole, while being provided with a communication hole that communicates with an oil passage extending through the crankshaft.

11. The eccentric coupling device according to claim 10, wherein the stopper insertion groove is aligned with the stopper hole when a center of the bush is positioned at a position spaced from a center of the crankshaft in accordance with a rotation of the bush.

* * * * *

UNITED STATES PATENT AND TRADEMARK OFFICE

CERTIFICATE OF CORRECTION

PATENT NO. : 7,150,609 B2
APPLICATION NO. : 10/872373
DATED : December 19, 2006
INVENTOR(S) : Kiem et al.

It is certified that error appears in the above-identified patent and that said Letters Patent is hereby corrected as shown below:

At column 11, line 62 (claim 1, line 11) of the printed patent, “hate” should be --hole--.

At column 13, line 10 (claim 10, line 7) of the printed patent, “filled” should be --fitted--.

Signed and Sealed this

Twenty-seventh Day of November, 2007

JON W. DUDAS
*Director of the United States Patent and Trademark Office*